US008910569B2

(12) United States Patent
Darr

(10) Patent No.: US 8,910,569 B2
(45) Date of Patent: Dec. 16, 2014

(54) DRIVE SYSTEM FOR A FORMING PRESS

(75) Inventor: Uwe Darr, Erfurt (DE)

(73) Assignee: Mueller Weingarten AG, Weingarten (DE)

( * ) Notice: Subject to any disclaimer, the term of this patent is extended or adjusted under 35 U.S.C. 154(b) by 547 days.

(21) Appl. No.: 13/055,862

(22) PCT Filed: Jun. 29, 2009

(86) PCT No.: PCT/DE2009/000913

§ 371 (c)(1),
(2), (4) Date: Jan. 25, 2011

(87) PCT Pub. No.: WO2010/009694

PCT Pub. Date: Jan. 28, 2010

(65) Prior Publication Data

US 2011/0126649 A1 Jun. 2, 2011

(30) Foreign Application Priority Data

Jul. 25, 2008 (DE) ..... 10 2008 034 971

(51) Int. Cl.
*B30B 1/06* (2006.01)
*B30B 1/26* (2006.01)

(52) U.S. Cl.
CPC ..... *B30B 1/266* (2013.01)
USPC ..... 100/282; 72/443; 72/452.5; 74/49

(58) Field of Classification Search
USPC ..... 74/40–45, 47–50; 100/281–283, 285; 72/449, 452.5, 453.02, 453.04, 454
See application file for complete search history.

(56) References Cited

U.S. PATENT DOCUMENTS

| | | | | |
|---|---|---|---|---|
| 4,014,232 | A * | 3/1977 | Mauger | 83/144 |
| 6,067,886 | A * | 5/2000 | Irwin | 83/615 |
| 6,595,125 | B2 * | 7/2003 | Kawado et al. | 100/282 |
| 7,102,316 | B2 * | 9/2006 | Beyer et al. | 318/625 |
| 7,143,617 | B2 * | 12/2006 | Futamura et al. | 72/20.1 |
| 7,165,437 | B2 * | 1/2007 | Shin et al. | 72/417 |
| 7,516,695 | B2 * | 4/2009 | Baba et al. | 100/257 |
| 8,549,940 | B2 * | 10/2013 | Darr et al. | 74/49 |
| 2009/0260460 | A1 | 10/2009 | Darr et al. | |
| 2011/0126649 | A1 * | 6/2011 | Darr | 74/44 |

FOREIGN PATENT DOCUMENTS

| | | | |
|---|---|---|---|
| DE | 10 2004 009 256 | 9/2005 | |
| DE | 10 2007 026 727 | 12/2007 | |
| EP | 1 082 185 | 3/2001 | |
| JP | 2000-288792 | 10/2000 | |
| WO | WO-2004/056559 | 7/2004 | |
| WO | WO-2006/045279 | 5/2006 | |
| WO | WO 2007140765 A2 * | 12/2007 | B30B 1/26 |

* cited by examiner

*Primary Examiner* — Troy Chambers
*Assistant Examiner* — Alexander Vu
(74) *Attorney, Agent, or Firm* — Jordan and Hamburg LLP

(57) ABSTRACT

The invention relates to a press drive by means of direct drive modules, wherein a space-saving construction with low height for the press can be achieved.

19 Claims, 7 Drawing Sheets

DRIVE SYSTEM FOR A FORMING PRESS

BACKGROUND OF THE INVENTION

The invention relates to a drive system for a multipoint forming press.

According to WO 2004/056559, a press apparatus having one pressure point is known in which a direct drive that is arranged directly on the eccentric shaft and that is in the form of a frequency-controlled three-phase motor controls the movement of the slide via a connecting rod. No arrangement of this direct drive in the entire structure of the press, especially in large presses with a plurality of pressure points, is disclosed.

DE 10 2004 009 256 is a mechanical multi-servopress having a drive for a press with two pressure points in which one or a plurality of servomotors are allocated to each eccentric element for the stroke movement of the slide.

Known from JP 2000288792 is another servopress having one or a plurality of direct drives, each in the form of a servomotor on a crank mechanism, the crankshaft of which acts on the slide via a connecting rod.

Known from EP 1 082 185 is a press in which the drive of the slide is created using tension from below by four threaded spindles that are each arranged vertically in the guide corners and that are mounted in the table and driven by a servomotor. This press, which is essentially free of head pieces, makes low structural height possible. The attainable pressing force and cycle rate for the system are limited by the performance of the threaded spindles. Regardless of the pressing force and the size of the tool clamping surface, this solution always requires four not inexpensive drive systems.

A reduced structural height is attained in a press according to DE 10 2004 052 007 in that the drive for the articulated lever mechanism mounted in the head piece is each arranged vertically through the drive modules, which comprise a linear motor or rotating servomotor with downstream linear converter, laterally adjacent to the head piece in the area of the press supports.

SUMMARY OF THE INVENTION

The underlying object of the invention is to create a drive system for a multipoint forming press for flexible movements and tilt control for the slide such that it is possible to attain a low structural height for the press, high accuracy in the guidance of the slide, and high pressing forces and numbers of strokes with the available torques of servomotors and with reduced technical complexity.

The core idea of the invention is to furnish the drive for the slide by means of direct drive modules, preferably without upstream toothed wheel gearing, and, for a space-saving construction with a low structural height of the press, to arrange the pressure points of the slide with the associated direct drive modules laterally adjacent to the tool clamping surface in the vertical plane of the drive supports, wherein the direct drive modules, each comprising servomotor, stroke mechanism, and holding brake, are aligned coaxially in the press longitudinal axis or in the press transverse axis. With the availability of high-performance servomotors, the stroke mechanism may be driven directly, without upstream toothed wheel gearing that creates additional complexity.

The stroke mechanism transforms the rotating drive movement of the servomotor into a linear drive movement of the slide.

In addition to the principle of the crank mechanism comprising an eccentric shaft with a mechanically linked crankshaft, for a space-saving construction a crank shifter may be used in which the eccentric element of the crankshaft is connected to a sliding block that is guided in a guide unit for the block that is mechanically linked to the pressure point of the slide.

By using the crank mechanism, it is possible to use the advantages of the distance-dependent passage through the lower reverse point for a high cycle rate so that the risks of getting stuck, which the known direct spindle drives suffer from, are avoided, especially at the lower reverse point in the high-pressure phase when the rotational direction of the spindle is reversed.

Activating the servomotor or servomotors allows the creation of flexible movement profiles for the slide. It is possible to attain different stroke heights for the slide by selecting a 360° circular mode or a <360° pendulum mode on the crankshaft.

Because of the direct drive modules separately allocated to each pressure point, it is possible to regulate the spatial tilt of the slide in two planes.

One additional spindle drive for adjusting the height of the slide and one pressure pad for protecting against hydraulic overload are integrated in a known manner at each pressure point for the slide.

Depending on the number of direct drive modules, presses may be configured with different pressing forces and expansion of the tool clamping surface.

In addition to using two or four direct drive modules arranged in the press longitudinal axis, in the press transverse axis four direct drive modules may be advantageously employed for the arrangement. Moreover, especially when the arrangement is in the press transverse axis, six or eight direct drive modules are even possible, especially in presses that have a high pressing force.

When the direct drive modules are aligned in the press longitudinal axis, they are advantageously mounted in the drive supports, which are each positioned bilaterally adjacent to the slide in the press transverse axis. Moreover, it is also possible for them to be mounted in drive supports positioned in the press longitudinal axis.

When the direct drive modules are aligned in the press transverse axis, in a first instance they may be mounted on the drive supports oriented bilaterally in front of and behind the slide in the press longitudinal axis. In a second case the direct drive modules are each positioned on the drive supports aligned transverse to the press longitudinal axis.

In every case the pressure points for the slide and its pressure point frames are arranged laterally adjacent to or in front of and behind the tool clamping surface in the vertical plane of the drive supports.

The compact construction of this mounting of the direct drive modules on the drive supports makes possible reduced structural height of the press and also permits the former limit from the monolithic construction of table, supports, and drive housing to shift towards longer lengths of the tool clamping surface.

It is possible to use a hybrid structure for the press frame in larger presses, depending on the pressing force and extension of the tool clamping surface. In a first instance the drive supports embodied as monoliths may be secured to the press table by means of tension rods. The press supports and the drive housing arranged in their vertical plane form one unit. In a second case, press supports and the drive housing, also arranged in their vertical plane, are separated and secured to the press table jointly by means of tension rods.

During the pressing process, the flux of force between the upper tool arranged on the slide and the lower die positioned on the pressing table is closed via the press supports, which also assume the guide function for the slide. With the arrangement of the direct drive modules in the vertical plane of the press supports, the elastic deformation of the press supports in the horizontal plane may be reduced during the pressing process, which increases the accuracy of the guidance of the slide. The more the pressure points are positioned in the area of the line of the vertical flux of force of the support, the lower the horizontal deformation of the press support towards the press longitudinal axis and the press transverse axis.

The direct drive modules may be employed either as an upper drive with pressing action or as a lower drive with tension action on the pressure points of the slide. The direct drive modules may be used in two-point or four-point presses that are preferably controllable in an electronically synchronized manner. It is also possible to synchronize adjacent direct drive modules mechanically as a group and in the case of a four-point press to control both groups relative to one another in an electronically synchronized manner.

In the case of mechanical synchronization in four-point presses, the group is preferably formed by two direct drive modules aligned in the press transverse axis.

When there is mechanical synchronization, each group of adjacent direct drive modules that are coupled via a shaft are jointly controllable by at least one servomotor. When using a servomotor, the latter may be arranged either on the input side or on the output side of the group or between the direct drive modules. When two servomotors per group are used, either both may be arranged between the direct drive modules or a first servomotor may be arranged on the input side and a second servomotor may be arranged on the output side of the group of direct drive modules. It is also possible to position a first servomotor on the input side of the group and a second servomotor between the direct drive modules.

If all of the direct drive modules are electronically synchronized, the servomotors may be arranged either in a mirror image on the sides facing towards or away from the two direct drive modules or a first servomotor may be arranged on the input side of the group and a second servomotor may be arranged between the direct drive modules.

Two independently acting frictional safety brakes may be employed as mechanical holding devices to satisfy mechanical and personal safety requirements. The brakes may be integrated in the motor or may be positioned separately at the free end of the crankshaft.

The invention shall be explained in greater detail in the following using exemplary embodiments.

DETAILED DESCRIPTION OF THE INVENTION

Figure 1:
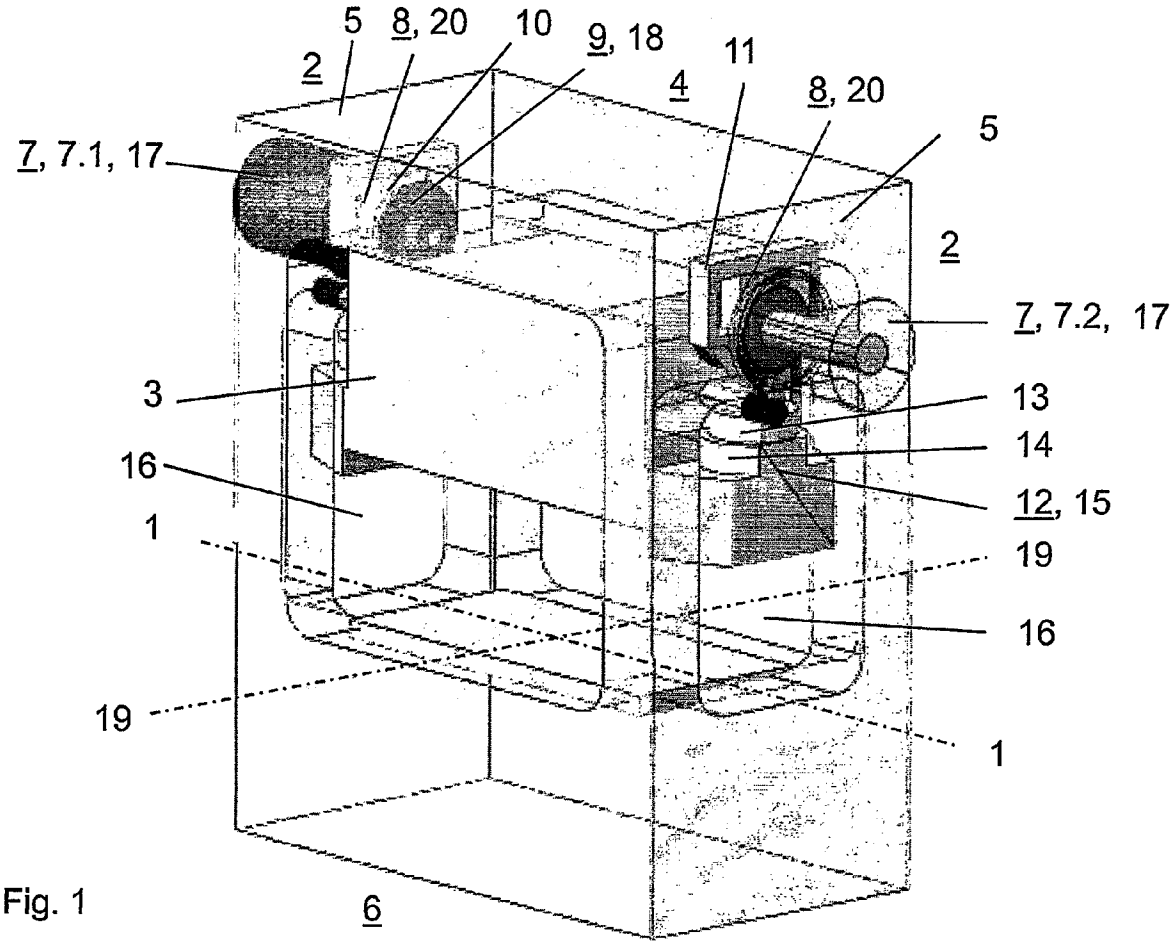
FIG. 1 depicts a drive system for a forming press having two electronically synchronizable direct drive modules, each aligned in the press longitudinal axis, for an upper drive.

In the first exemplary embodiment, a two-point forming press can be seen in FIG. 1, and its two direct drive modules 2 aligned in the press longitudinal axis 1 are connected to the slide 3 as an upper drive 4. Each direct drive module 2 comprises a servomotor 7 mounted in the upper part of a respective drive support 5 formed by the monolithic body 6, crank mechanism 8, and holding device 9, the crank mechanism 8 including a crankshaft 20 and a sliding block 10 that is supported via a guide shifter 11 in the pressure point 12 of the slide 3. The pressure points 12, each comprising a spindle-actuated pressure point displacement unit 13 and overload protection 14, are positioned on the pressure point frame 15 that is placed in a projection-like manner on the slide 3. The pressure point frames 15 project into the space 16 below the drive supports 5 that are aligned transverse to the press longitudinal axis 1 so that, in conjunction with the short stroke drive, there is a more compact press structure that permits in particular a low structural height.

While the servomotors 7.1, 7.2 in FIG. 1 are each arranged in a mirror image on the outsides of the drive supports 5, they may likewise each be positioned in a mirror image on the insides of the drive supports 5 between the direct drive modules 2. This space-saving manner of construction in the press longitudinal axis 1 is particularly advantageous to use when two or more forming presses are arranged sequentially in the press longitudinal axis 1. The servomotors 7 are advantageously embodied as hollow shaft motors 17 and the holding devices 9 are embodied as rotary brakes 18, preferably as frictional safety brakes. According to FIG. 1, the servomotors 7 and the rotary brakes 18 are each positioned separately on opposing sides of the drive supports 5. Moreover, it is likewise also possible to integrate the holding device 9 in the servomotor 7.

The freely programmable servomotors 7 may produce a synchronous movement of the slide 3 using electronic coupling, and may compensate a tilt in the slide 3 using a spatial tilt control in two planes as a result of the elastic resilience when there is an off-center load or may create a target tilt.

It is also possible for both direct drive modules 2 to be jointly controllable either via a couplable shaft from both servomotors 7.1, 7.2 or from one servomotor 7.

Figure 2:
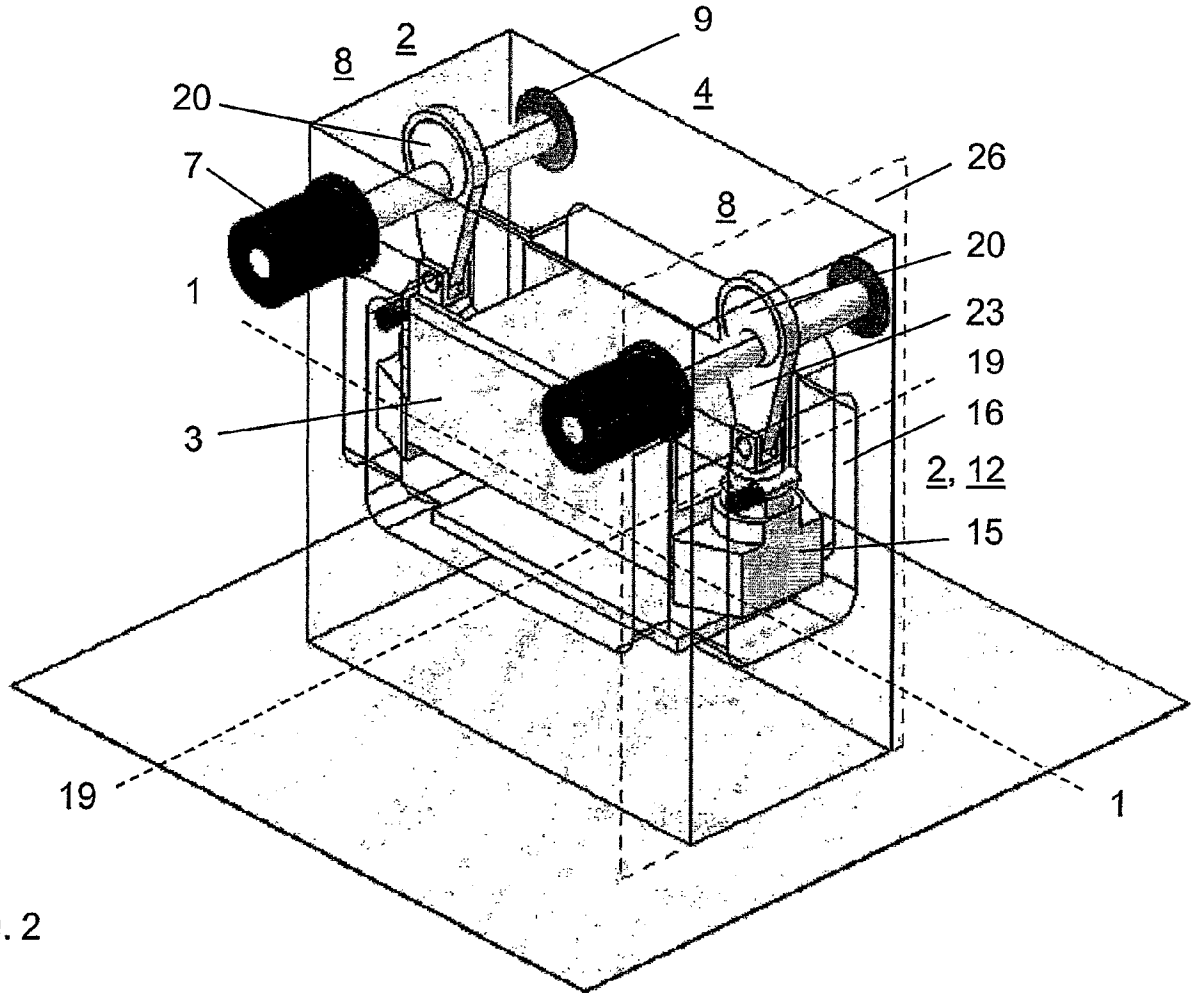
FIG. 2 depicts a drive system for a forming press having two electronically synchronizable direct drive modules, each aligned in the press transverse axis, for an upper drive.

A two-point forming press with the two direct drive modules 2 for an upper drive 4 aligned in the press transverse axis 19 may be seen in the second exemplary embodiment according to FIG. 2. As in the first exemplary embodiment, the two drive supports 5 are positioned transverse to the press longitudinal axis 1, and the pressure point frames 15 project into the spaces 16 thereof. The advantage over the first exemplary embodiment is essentially that the transverse drive forces are compensated by the opposing movement of the two crank mechanisms 8 so that it is possible to avoid more complex measures for compensating masses. The crank mechanism 8 comprises a crankshaft 20 that is driven directly by the servomotor 7 and that is supported via a mechanically linked connecting rod 23 in the pressure point 12 of the slide 3. Moreover, each crankshaft 20 is connected at its back shaft end to a holding device 9 supported on the drive supports 5.

This embodiment may be expanded to a four-point forming press in that two direct drive modules 2 are arranged one after the other in the press transverse axis 19. In this case, then, two pressure point frames 15, each allocated to a pressure point 12, project into the space 16 of the drive supports 5 aligned in the press transverse 19 axis. Either a separate servomotor 7 may be allocated to each direct drive module 2, or both direct drive modules 2 are jointly driven by one or two servomotors 7 that are mechanically coupled.

Figure 3:
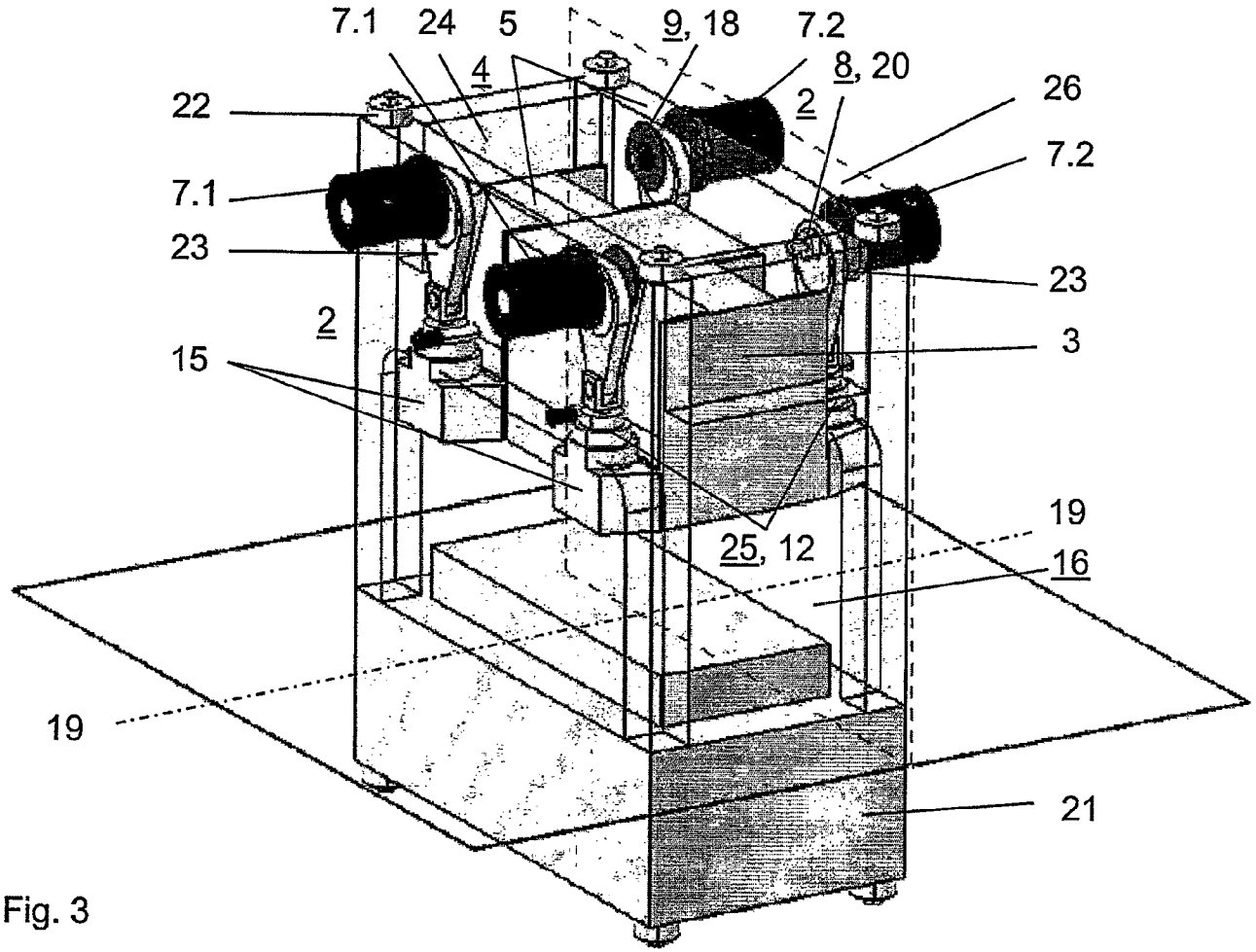
FIG. 3 depicts a first embodiment of a drive system for a forming press having four electronically synchronizable direct drive modules, each aligned in the press transverse axis, for an upper drive.

In the third exemplary embodiment according to FIG. 3, the direct drive modules 2 are set up in the press transverse axis 19 in a four-point forming press. If the structural size of the press does not permit a monolithic body as in the preceding exemplary embodiments, the direct drive modules 2 depicted here are mounted in pairs on drive supports 5 that are secured to the press table 21 via tension rods 22. The crank mechanism 8 that belongs to the direct drive module 2 and is controlled by the servomotor 7 comprises a connecting rod 23 that is mechanically linked to the crankshaft 20 and that is supported in the pressure point 12 of the slide 3. The pressure points 12 of the four-point drive are positioned on the pressure point frames 15 that are placed in a projection-like manner on the slide 3 and that project into the space 16 of the drive supports 5 aligned transverse to the press transverse axis 19. The two servo motors 7.1, 7.2 are arranged in a mirror image on the sides facing away from the two direct drive modules 2. It is likewise possible for both direct drive modules 2 to be jointly controllable either by both servomotors 7.1, 7.2 via a shaft that can be attached or by a servomotor 7. Rotary brakes 18 that are arranged in a mirror image on the sides facing the two direct drive modules 2 act as act as a holding device 9 on two diagonally opposing direct drive modules 2.

Figure 4:
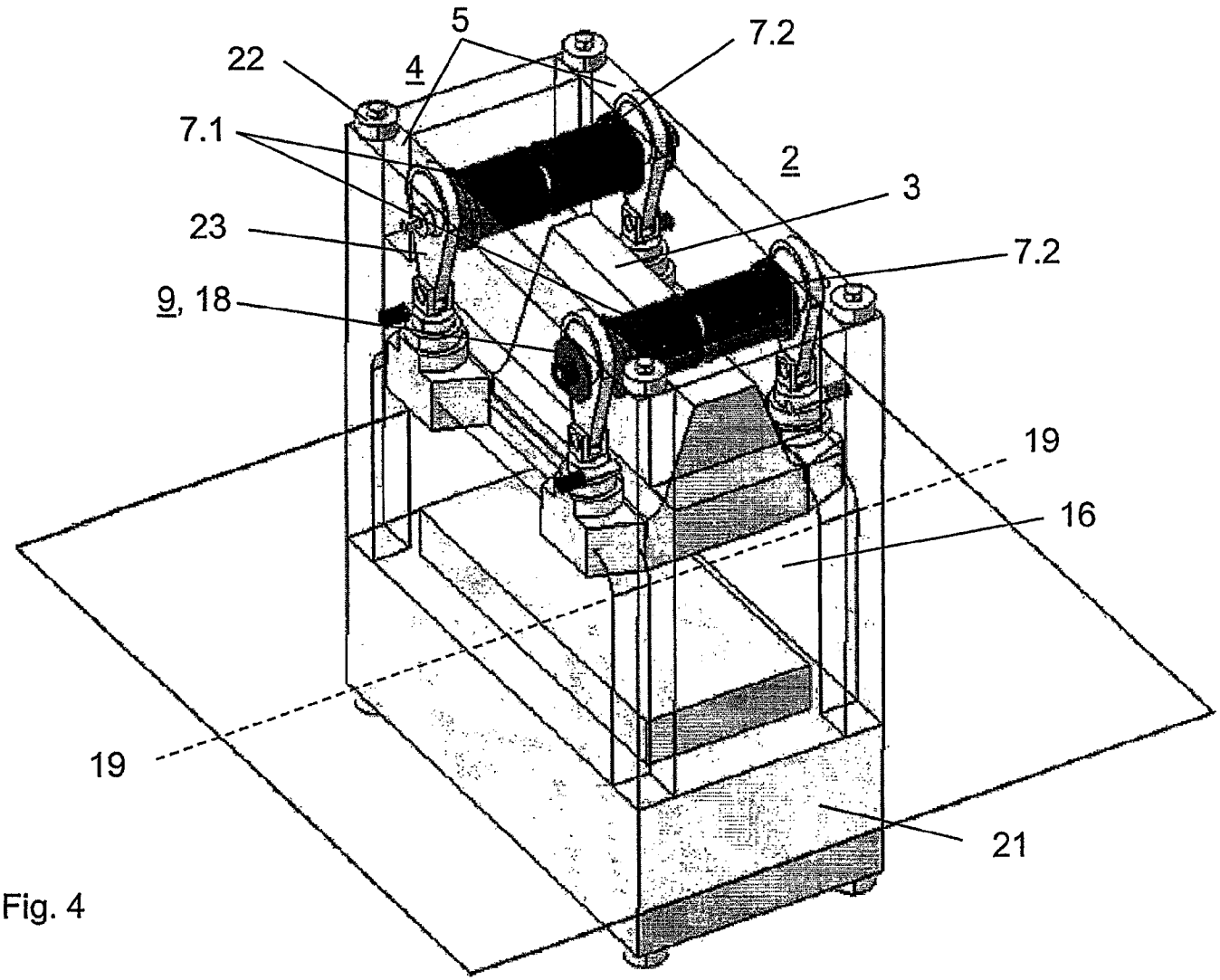
FIG. 4 depicts a second embodiment of a drive system for a forming press having four electronically synchronizable direct drive modules, each aligned in the press transverse axis, for an upper drive.

The fourth exemplary embodiment according to FIG. 4 is distinguished from FIG. 3 in that the servomotors 7.1, 7.2 are arranged in a mirror image on the sides facing the two direct drive modules 2. As in the third exemplary embodiment, it is possible both to have mechanical coupling of the two servomotors 7.1, 7.2 and also to have one servomotor 7 for jointly driving the two direct drive modules 2.

Figure 5:
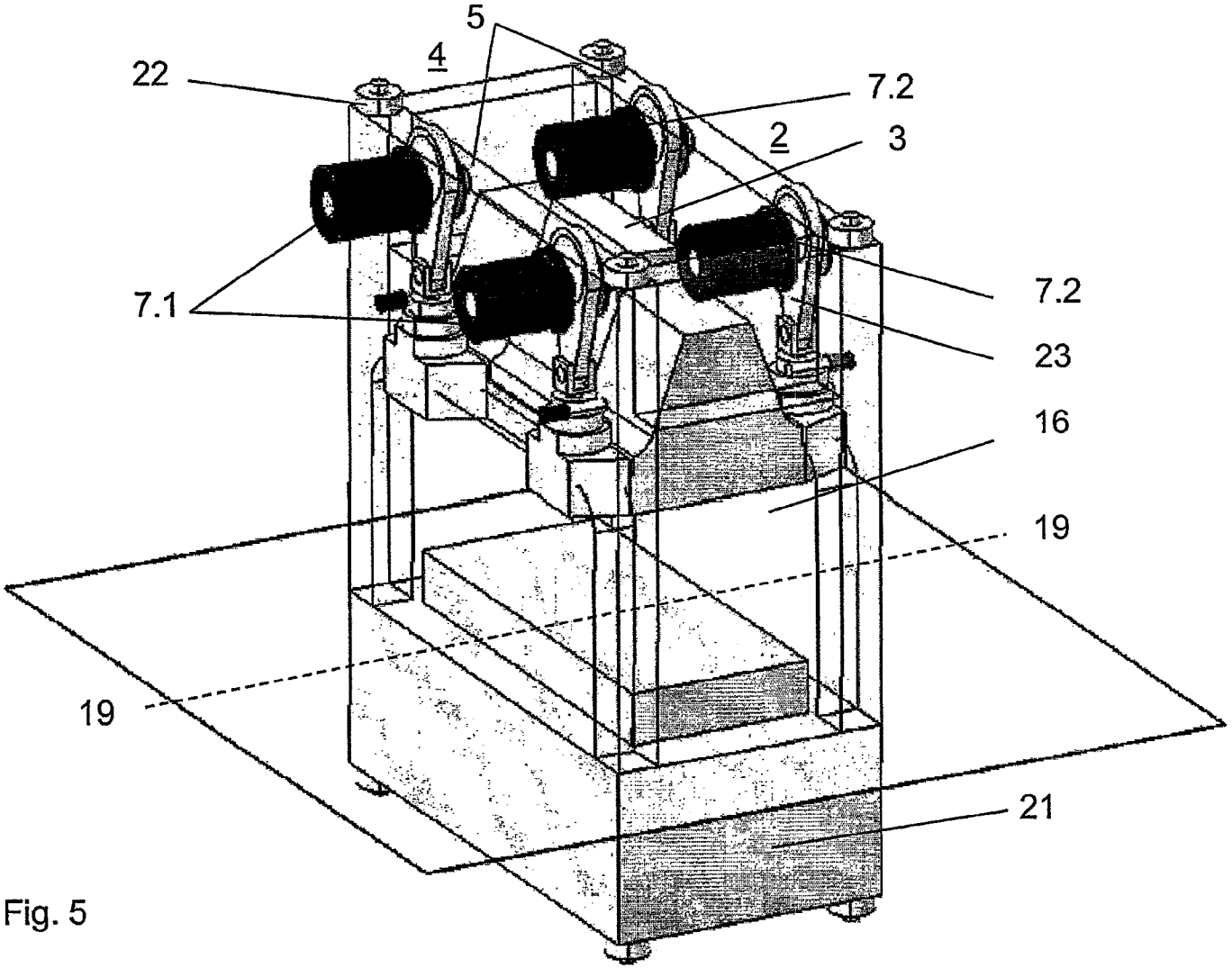
FIG. 5 depicts a third embodiment of a drive system for a forming press having four electronically synchronizable direct drive modules, each aligned in the press transverse axis, for an upper drive.

In a third embodiment of a four-point forming press according to FIG. 5, in the group of direct drive modules 2 each first servomotor 7.1 is arranged on the input side and each second servomotor 7.2 is arranged between the direct drive modules 2.

This possible arrangement of the servomotors 7 according to FIG. 4 and FIG. 5 offers spatial advantages, especially when a plurality of large multipoint presses in a press line are positioned with the workpiece flow in the direction of the press transverse axis 19 at a minimum distance from one another.

Figure 6:
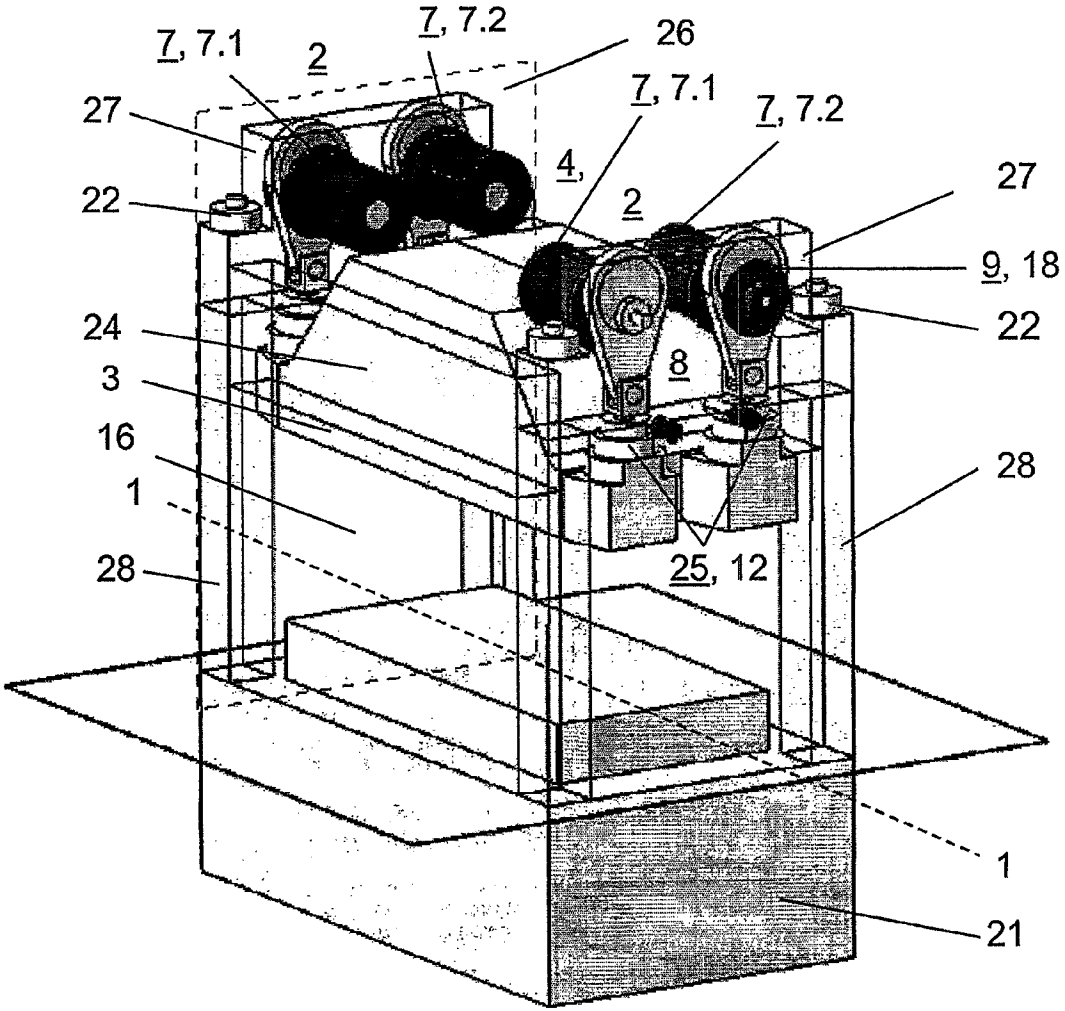
FIG. 6 depicts a drive system for a forming press having four electronically synchronizable direct drive modules, each aligned in the press longitudinal axis, for an upper drive.

FIG. 6 describes the embodiment of a four-point forming press having two groups of direct drive modules 2 aligned in the press longitudinal axis, each direct drive module 2 being mounted in a drive housing 27 positioned in the press transverse axis 19. The drive housings 27 are secured via the press supports 28 to the press table 21 by means of tension rods 22. The adjacent press supports 28 in the press longitudinal axis 1 are connected to one another using a transverse member 24. The servomotors 7 are arranged in a mirror image between the direct drive modules 2, the two adjacent servomotors 7.1 and 7.2 in each group being controlled in opposition to one another in order to compensate the transverse forces produced on the associated crank mechanisms 8.

Figure 7:
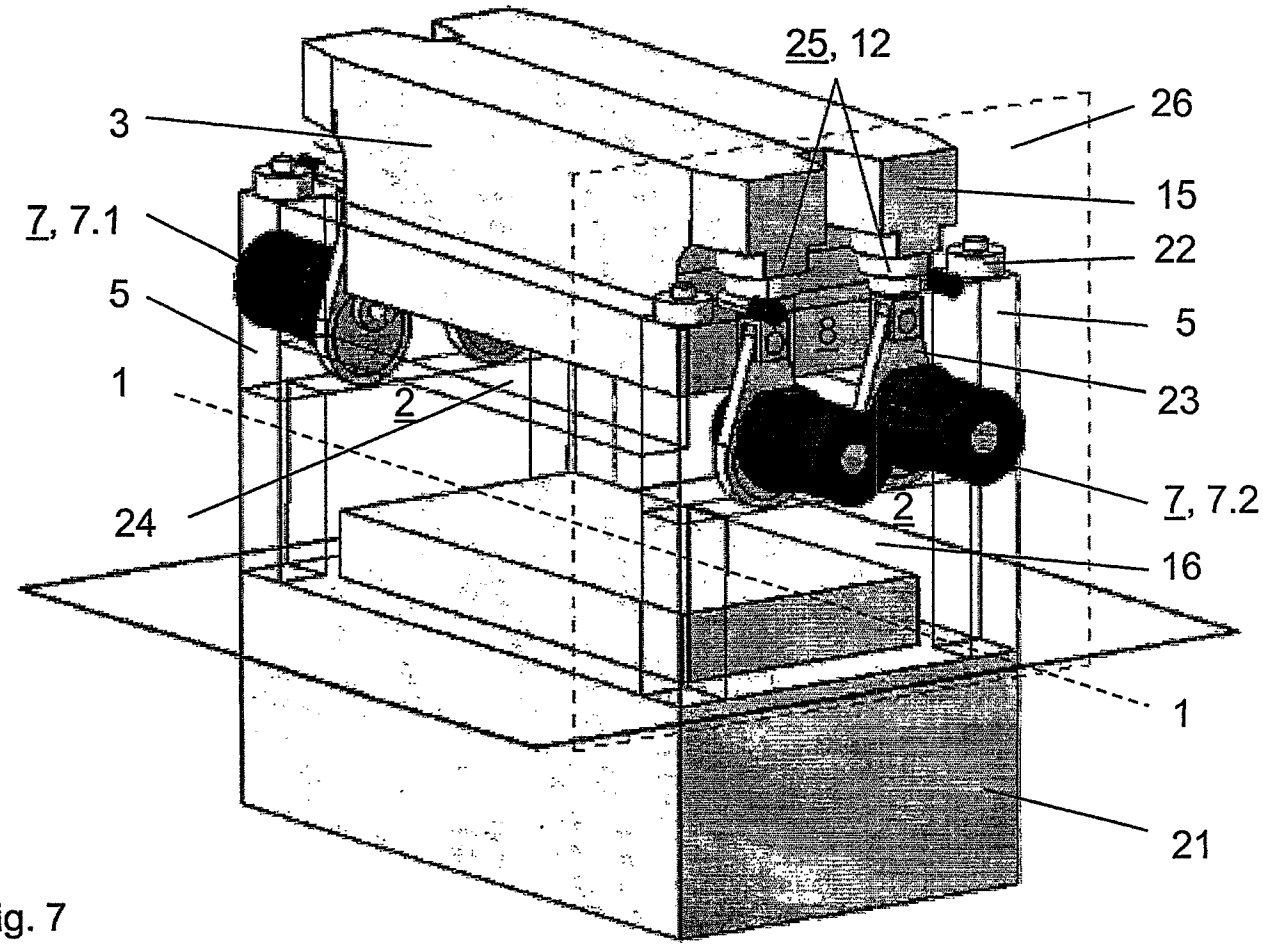
FIG. 7 depicts a drive system for a forming press having four electronically synchronizable direct drive modules, each aligned in the press longitudinal axis, for a lower drive.

One drive system for a lower drive in a four-point forming press can be seen in FIG. 7. Each two of four direct drive modules 2 aligned in press longitudinal axis 1 are mounted on a respective drive support 5. The drive supports 5 are positioned transverse to the press longitudinal axis 1. Compared to the preceding exemplary embodiments with the upper drive, in the lower drive the pressing force in the crank mechanism 8 acts in the traction direction. The pressure points 12 connected to the connecting rods 23 act on the pressure point frames 15 that are arranged in the upper area of the slide 3 and that project into the upper clearance of the drive supports 5. This compact construction provides a particularly low structural height for the press system.

It is common to all of the embodiments that the direct drive modules 2 are arranged in the vertical place of the drive supports 26. Thus drive supports 5 in one case may be connected to the table 2 either monolithically or by means of tension rods 22. In another case, the drive supports 5 are each divided into a drive housing 27 and associated press supports 28 that are jointly connected to the table 2 by means of tension rods 22. As can be seen in drawings, it is also common to all the embodiments that the drive supports 5 are situated adjacent the space 16 which has as its upper extremity the tool mounting surface of the slide and as its lateral extremities innermost edges of vertical, upright supports, such as the legs of the monolithic body or the press supports 28, supporting the drive supports 5 and which innermost edges are vertical projections of innermost extremities of the drive supports 5. Allocated to all of the direct drive modules 2 are servomotors 7 with which it is possible to achieve flexible path and speed profiles for the movement of the slide 3, the target positions of the slide 3 preferably being produced using guide wave-controlled electronic cams. With respect to the path profile, a 360° circular movement, a reversing movement at an angle <360° that passes through the bottom reverse point, or a movement at an angle <180° that reverses in the area of the bottom reverse point may be selected. The latter mode may preferably be used in conjunction with the tilt regulation of the slide 3 that is possible with electronic synchronization of the pressure points 12, in one plane for a two-point forming press or in two planes for a four-point forming press.

The invention claimed is:

1. A drive system for a multi-point forming press, having a plurality of pressure points, for movement of a slide having a surface for mounting a tool thereon, the drive system comprising direct drive modules aligned in a longitudinal or a transverse axis of the press, each or each pair of the direct drive modules being mounted on a respective one of a pair of uprights for the direct drive modules, and each of the direct drive modules comprising a respective servomotor and a respective crank mechanism, and the direct drive modules further comprising a holding device for at least two of said modules, and pressure point housings of the slide arranged laterally of the tool mounting surface and extending into space between the uprights, each of the pressure points being operatively connected to the pressure point housings of the slide by one of the crank mechanisms controlled by one of the servomotors, each of the servomotors together with another of the servomotors being jointly controlled in an electronically or in a mechanically synchronized manner.

2. The drive system for the multipoint forming press according to claim 1, wherein the direct drive modules are aligned in the longitudinal axis and the uprights for the direct drive modules are aligned in the transverse axis.

3. The drive system for the multipoint forming press according to claim 1, wherein the direct drive modules are aligned in the transverse axis and the uprights for the direct drive modules are aligned in the longitudinal axis.

4. The drive system for the multipoint forming press according to claim 1, wherein the direct drive modules are aligned in the transverse axis and the uprights for the direct drive modules are aligned in the transverse axis.

5. The drive system for the multipoint forming press according to claim 1, wherein the direct drive modules are aligned in the longitudinal axis and the uprights for the direct drive modules are aligned in the longitudinal axis.

6. The drive system for the multipoint forming press according to claim 1, wherein the crank mechanism of each of the direct drive modules comprises a crankshaft that is mechanically linked on a drive side to a servomotor and holding device, which are arranged coaxially with the crankshaft, and on the driven side to a connecting rod.

7. The drive system for the multipoint forming press according to claim 1, wherein the crank mechanism of each of the direct drive modules comprises a crankshaft that is mechanically linked on the drive side to a servomotor and holding device, which are arranged coaxially with the crankshaft, and on the driven side via a sliding block to a guide shifter.

8. The drive system for the multipoint forming press according to claim 1, wherein the uprights for the direct drive modules are each connected integrally to a table of the press and to one another via transverse members.

9. The drive system for the multipoint forming press according to claim 8, wherein the uprights for the direct drive modules and the transverse members are connected to the table via tension rods.

10. The drive system for the multipoint forming press according to claim 1, wherein the uprights for the direct drive modules each comprise a housing and a press support that are connected to the table via the tension rods.

11. The drive system for the multipoint forming press according to claim 1, wherein only one of the servomotors jointly controls the two of the direct drive modules and the one servomotor is arranged between the two direct drive modules.

12. The drive system for the multipoint forming press according to claim 1, wherein two of the servomotors control the two of the direct drive modules and the two servomotors are arranged between the two direct drive modules.

13. The drive system for the multipoint forming press according to claim 1, wherein one of the servomotors is arranged on an input side of the group of direct drive modules.

14. The drive system for the multipoint forming press according to claim 1, wherein a first of the servomotors is arranged on an input side and a second of the servomotors is arranged on an output side of the group of direct drive modules.

15. The drive system for the multipoint forming press according to claim 1, wherein a first of the servomotors is arranged on an input side of the group of direct drive modules and a second of the servomotors is arranged between the direct drive modules.

16. The drive system for the multipoint forming press according to claim 1, wherein each of the two direct drive modules forming a group is separately controlled by at least one servomotor.

17. The drive system for the multipoint forming press according to claim 16, wherein two of the servomotors are arranged in a mirror image on the sides facing away from the two direct drive modules.

18. The drive system for the multipoint forming press according to claim 16, wherein two of the servomotors are arranged in a mirror image on sides facing towards the two direct drive modules.

19. The drive system for the multipoint forming press according to claim 16, wherein a first servomotor is arranged on an input side of the group of direct drive modules and a second servomotor is arranged between the direct drive modules.

* * * * *